US009558872B2

(12) United States Patent
Yamazaki et al.

(10) Patent No.: US 9,558,872 B2
(45) Date of Patent: Jan. 31, 2017

(54) R-T-B RARE EARTH SINTERED MAGNET, ALLOY FOR R-T-B RARE EARTH SINTERED MAGNET, AND METHOD OF MANUFACTURING THE SAME

(71) Applicant: SHOWA DENKO K.K., Tokyo (JP)

(72) Inventors: Takashi Yamazaki, Chichibu (JP); Kenichiro Nakajima, Chichibu (JP)

(73) Assignee: SHOWA DENKO K.K., Tokyo (JP)

( * ) Notice: Subject to any disclaimer, the term of this patent is extended or adjusted under 35 U.S.C. 154(b) by 421 days.

(21) Appl. No.: 14/146,098

(22) Filed: Jan. 2, 2014

(65) Prior Publication Data

US 2014/0191831 A1 Jul. 10, 2014

(30) Foreign Application Priority Data

Jan. 7, 2013 (JP) ..... 2013-000445
Dec. 11, 2013 (JP) ..... 2013-256492

(51) Int. Cl.
*H01F 1/053* (2006.01)
*H01F 1/40* (2006.01)
(Continued)

(52) U.S. Cl.
CPC ..... *H01F 1/40* (2013.01); *H01F 1/0571* (2013.01); *H01F 1/0577* (2013.01); *H01F 41/0266* (2013.01); *H01F 41/0293* (2013.01)

(58) Field of Classification Search
None
See application file for complete search history.

(56) References Cited

U.S. PATENT DOCUMENTS 6,447,621 B1 * 9/2002 Tokoro ..... H01F 1/0577 148/302
2010/0282371 A1 * 11/2010 Sagawa ..... H01F 1/0557 148/302

FOREIGN PATENT DOCUMENTS

CN 1114779 A 1/1996
CN 1510700 A 7/2004
(Continued)

OTHER PUBLICATIONS

Communication dated Dec. 17, 2015, issued by the State Intellectual Property Office of the P.R.C. in corresponding Chinese Application No. 201410001076.6.
(Continued)

*Primary Examiner* — George Wyszomierski
*Assistant Examiner* — Ngoclan T Mai
(74) *Attorney, Agent, or Firm* — Sughrue Mion, PLLC

(57) ABSTRACT

An R-T-B rare earth sintered magnet contains R which represents a rare earth element; T which represents a transition metal essentially containing Fe; a metal element M which represents Al and/or Ga; B; Cu; and inevitable impurities the R-T-B rare earth sintered magnet including 13.4 to 17 at % of R, 4.5 to 5.5 at % of B, and 0.1 to 2.0 at % of M, and T as the balance; in which the R-T-B rare earth sintered magnet is formed of a sintered body which includes a main phase composed of $R_2Fe_{14}B$ and a grain boundary phase including a larger amount of R than the main phase; in which the magnetization direction of the main phase is a c-axis direction, in which crystal grains of the main phase have one of an elliptical shape and an oval shape extended in such a direction so as to cross the c-axis direction; and in which the grain boundary phase includes an R-rich phase in which the total atomic concentration of the rare earth elements is 70 at % or greater and a transition metal-rich
(Continued)

phase in which the total atomic concentration of the rare earth elements is 25 to 35 at %.

3 Claims, 6 Drawing Sheets

(51) Int. Cl.
*H01F 1/057* (2006.01)
*H01F 41/02* (2006.01)

(56) References Cited

FOREIGN PATENT DOCUMENTS

| | | | |
|---|---|---|---|
| CN | 102568809 | A | 7/2012 |
| JP | 07-283016 | A | 10/1995 |
| JP | 2007-119882 | A | 5/2007 |
| JP | 2009-231391 | A | 10/2009 |

OTHER PUBLICATIONS

Masato Sagawa, "Permanent Magnet-Materials Science and Application", First Edition Second Impression, Nov. 30, 2008, pp. 256-261.
Masato Sagawa, "All about Neodymium Magnet—Let's Protect Earth with Rare Earth", First Print of the First Edition, Apr. 30, 2011, pp. 104-105.

* cited by examiner

R-T-B RARE EARTH SINTERED MAGNET, ALLOY FOR R-T-B RARE EARTH SINTERED MAGNET, AND METHOD OF MANUFACTURING THE SAME

BACKGROUND OF THE INVENTION

Field of the Invention

The present invention relates to an R-T-B rare earth sintered magnet, an alloy for an R-T-B rare earth sintered magnet, and a method of manufacturing the alloy, and particularly, to an R-T-B rare earth sintered magnet having excellent magnetic properties.

Priority is claimed on Japanese Patent Application No. 2013-000445, filed on Jan. 7, 2013 and Japanese Patent Application No. 2013-256492, filed on Dec. 11, 2013, the contents of which are incorporated herein by reference.

Description of Related Art

Hitherto, R-T-B rare earth sintered magnets (hereinafter, may be referred to as "R-T-B magnets") have been used in motors such as voice coil motors of hard disk drives and motors for engines of hybrid vehicles and electric vehicles.

R-T-B magnets are obtained by molding an R-T-B alloy powder containing Nd, Fe, and B as main components and by sintering the resulting molded product. In general, in R-T-B alloys, R is Nd, part of which is substituted by other rare earth elements such as Pr, Dy, and Tb. T is Fe, part of which is substituted by other transition metals such as Co and Ni. B is boron, part of which can be substituted by C or N.

Normal R-T-B magnets have a structure constituted mainly of a main phase consisting of $R_2T_{14}B$ and an R-rich phase which is present at the grain boundaries of the main phase and has a higher Nd concentration than the main phase. The R-rich phase is also referred to as a grain boundary phase.

In general, regarding the composition of R-T-B magnets, the ratios of Nd, Fe, and B are adjusted to be as close to $R_2T_{14}B$ as possible, in order to increase the ratio of the main phases in the structure of an R-T-B magnet (for example, see Permanent Magnet-Materials Science and Application—(Masato Sagawa, Nov. 30, 2008, second print of the first edition, pgs. 256 to 261)).

In addition, R-T-B alloys may include an $R_2T_{17}$ phase. The $R_2T_{17}$ phase is known as a cause of a reduction in coercivity and squareness of R-T-B magnets (for example, see Japanese Unexamined Patent Application, First Publication No. 2007-119882). Therefore, hitherto, an $R_2T_{17}$ phase has been eliminated during the course of sintering in order to manufacture an R-T-B magnet when the $R_2T_{17}$ phase is present in an R-T-B alloy.

In addition, since R-T-B magnets which are used in motors for vehicles are exposed to high temperatures in the motors, high coercivity (Hcj) is required.

There is a technology used to replace Nd with Dy for R of an R-T-B alloy as a technology used to improve the coercivity of the R-T-B magnet. However, Dy is unevenly distributed and its output is also limited. Accordingly, the supply of Dy is unstable. Therefore, technologies, which improve the coercivity of an R-T-B magnet without increasing the amount of Dy contained in an R-T-B alloy, are known.

There is a technology which adds a metal element such as Al, Si, Ga, and Sn in order to improve the coercivity (Hcj) of an R-T-B magnet (for example, see Japanese Unexamined Patent Application, First Publication No. 2009-231391). In addition, as described in Japanese Unexamined Patent Application, First Publication No. 2009-231391, Al and Si are known to be mixed as inevitable impurities into the R-T-B magnet.

In addition, All about Neodymium Magnet-Let's Protect Earth with Rare Earth-(Masato Sagawa, Apr. 30, 2011, first print of the first edition, pgs. 104 to 105) states that it is desirable to cause crystal grains of a magnet to have a shape extended in a direction of an axis of easy crystal magnetization, in order to minimize the influence of magnetostatic interaction when adjacent grains are subjected to magnetization reversal.

SUMMARY OF THE INVENTION

In the prior arts, however, R-T-B magnets having sufficiently high coercivity (Hcj) may not be obtained even when a metal element such as Al, Si, Ga, Sn, and Cu is added to an R-T-B alloy. As a result, it is necessary to increase the Dy concentration even when the metal element is added. Therefore, it is necessary to supply an R-T-B magnet having high coercivity without increasing the amount of Dy.

The invention is contrived in view of the circumstances, and an object thereof is to provide an R-T-B magnet having high coercivity without increasing the amount of Dy.

Another object is to provide an alloy for an R-T-B rare earth sintered magnet with which an R-T-B magnet having high coercivity is obtained, and a method of manufacturing the alloy.

The inventors of the invention have conducted numerous intensive studies to achieve the objects.

As a result, they have found that an R-T-B magnet having high coercivity is obtained when the R-T-B magnet has a main phase mainly including $R_2Fe_{14}B$ and a grain boundary phase including a larger amount of R than the main phase, wherein the grain boundary phase includes a conventionally-known grain boundary phase (R-rich phase) having a high rare earth element concentration and a grain boundary phase (transition metal-rich phase) having a lower rare earth element concentration and a higher transition metal element concentration than the conventional grain boundary phase.

In addition, the inventors of the invention have conducted studies as follows with regard to the composition of an R-T-B alloy in order to effectively exhibit a coercivity improving effect in an R-T-B magnet including a transition metal-rich phase.

The transition metal-rich phase has a lower total atomic concentration of rare earth elements and has a higher Fe atomic concentration than other grain boundary phases. Accordingly, the inventors of the invention have studied increasing the Fe concentration and reducing the B concentration. As a result, they have found that the coercivity is maximized when a specific B concentration is reached.

Furthermore, the inventors of the invention have repeatedly conducted intensive studies and found that the coercivity is improved when the magnetization direction of the main phase is the c-axis direction and crystal grains of the main phase have an elliptical shape or an oval shape extended in such a direction so as to cross the c-axis direction. In addition, they have also found that such an R-T-B magnet is obtained by sintering an alloy for an R-T-B magnet having a main phase and a grain boundary phase with a predetermined composition, in which the distance between adjacent grain boundary phases is 1.5 μm to 2.8 μm. Furthermore, they have also found that such an alloy for an R-T-B magnet can be manufactured by obtaining a cast alloy having an average thickness of 0.15 mm to 0.27 mm through separation of the cast alloy from a cooling roll at 400° C. to 600° C. in a casting step of producing a cast alloy using a strip cast method, and devised the invention.

(1) An R-T-B rare earth sintered magnet including R which represents a rare earth element; T which represents a transition metal essentially containing Fe; a metal element M which represents Al and/or Ga; B; Cu; and inevitable impurities, wherein the R-T-B rare earth sintered magnet contains 13.4 to 17 at % of R, 4.5 to 5.5 at % of B, and 0.1 to 2.0 at % of M and T as the balance; wherein the R-T-B rare earth sintered magnet is formed of a sintered body which includes a main phase composed of $R_2Fe_{14}B$ and a grain boundary phase including a larger amount of R than the main phase; wherein a magnetization direction of the main phase is a c-axis direction; wherein crystal grains of the main phase have one of an elliptical shape and an oval shape extended in such a direction so as to cross the c-axis direction; and wherein the grain boundary phase includes an R-rich phase in which a total atomic concentration of the rare earth elements is 70 at % or greater, and a transition metal-rich phase in which a total atomic concentration of the rare earth elements is 25 to 35 at %.

(2) The R-T-B rare earth sintered magnet according to (1), wherein 50% or more of the crystal grains of the main phase have an aspect ratio of 2 or greater.

(3) The R-T-B rare earth sintered magnet according to (1) or (2), further including 0.05 to 1.0 at % of Zr.

(4) An alloy for an R-T-B rare earth sintered magnet including R which represents a rare earth element; T which represents a transition metal essentially containing Fe; a metal element M which represents Al and/or Ga; B; Cu; and inevitable impurities; wherein the R-T-B rare earth sintered magnet contains 13.4 to 17 at % of R, 4.5 to 5.5 at % of B, and 0.1 to 2.0 at % of M, and T as the balance; wherein a main phase composed of $R_2Fe_{14}B$ and a grain boundary phase including a larger amount of R than the main phase are included; and wherein a distance between adjacent grain boundary phases is 1.5 μm to 2.8 μm.

(5) A method of manufacturing an alloy for an R-T-B rare earth sintered magnet, comprising a casting step of producing a cast alloy using a strip cast method including supplying a molten alloy to a cooling roll and solidifying the molten alloy; wherein the molten alloy contains R which represents a rare earth element, T which represents a transition metal essentially containing Fe, a metal element M which represents Al and/or Ga, B, Cu, and inevitable impurities; wherein the molten alloy contains 13.4 to 17 at % of R, 4.5 to 5.5 at % of B, 0.1 to 2.0 at % of M, and T as the balance, and wherein in the casting step, the cast alloy is removed from the cooling roll at 400° C. to 600° C. to obtain the cast alloy having an average thickness of 0.15 mm to 0.27 mm.

(6) The method of manufacturing an alloy for an R-T-B rare earth sintered magnet according to (5), wherein the average cooling rate until the molten metal supplied to the cooling roll is removed as the cast alloy from the cooling roll is 800° C./s to 1000° C./s.

An R-T-B based rare earth sintered magnet of the invention has a predetermined composition and is formed of a sintered body having a main phase and a grain boundary phase; in which the magnetization direction of the main phase is the c-axis direction, the crystal grains of the main phase have an elliptical shape or an oval shape extended in such a direction so as to cross the c-axis direction, and the grain boundary phase includes an R-rich phase in which the total atomic concentration of the rare earth elements is 70 at % or greater and a transition metal-rich phase in which the total atomic concentration of the rare earth elements is 25 to 35 at %. Accordingly, high coercivity is obtained without increasing the amount of Dy.

An alloy for an R-T-B rare earth sintered magnet of the invention has a predetermined composition and includes a main phase and a grain boundary phase, and distance between adjacent grain boundary phases are 1.5 μm to 2.8 μm. Accordingly, by sintering the alloy, an R-T-B rare earth sintered magnet having high coercivity in which the magnetization direction of a main phase is the c-axis direction, crystal grains of the main phase have an elliptical shape or an oval shape extended in such a direction so as to cross the c-axis direction, and the grain boundary phase includes an R-rich phase and a transition metal-rich phase is obtained.

A method of manufacturing an alloy for an R-T-B rare earth sintered magnet of the invention is a method in which in a casting step of producing a cast alloy using a strip cast method, the cast alloy having a predetermined composition is removed from a cooling roll at 400° C. to 600° C. to obtain the cast alloy having an average thickness of 0.15 mm to 0.27 mm. Accordingly, an alloy for an R-T-B rare earth sintered magnet which includes a main phase and a grain boundary phase and in which distances between adjacent grain boundary phases are 1.5 μm to 2.8 μm is obtained.

BRIEF DESCRIPTION OF THE DRAWINGS

FIG. 5A is a microscope photograph of Test Example 4, FIG. 5B is a microscope photograph of Comparative Example 1, and FIG. 5C is a microscope photograph of Comparative Example 2.

DETAILED DESCRIPTION OF THE INVENTION

Figure 1A:
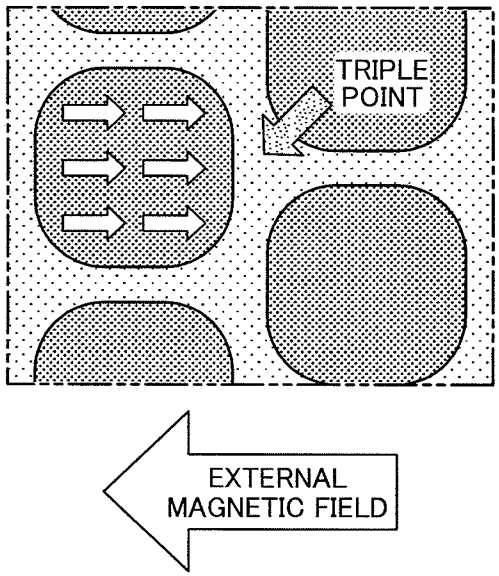
FIGS. 1A to 1C are schematic diagrams which show a coercivity mechanism (magnetic domain reversal) of an R-T-B magnet.

Hereinafter, embodiments of the invention will be described in detail.

[R-T-B Magnet]

An R-T-B rare earth sintered magnet (hereinafter, abbreviated as "R-T-B magnet") of this embodiment has a composition containing R which represents a rare earth element, T which represents a transition metal essentially containing Fe, a metal element M which represents Al and/or Ga, B, Cu, and inevitable impurities.

The R-T-B magnet of this embodiment contains 13.4 to 17 at % of R, 4.5 to 5.5 at % of B, 0.1 to 2.0 at % of M, and the balance of T. The R-T-B magnet of this embodiment may contain 0.05 to 1.0 at % of Zr.

When the amount of R which represents a rare earth element is 13.4 at % or greater, an R-T-B magnet having high coercivity is obtained. When the amount of R is greater than 17 at %, remanence of the R-T-B magnet becomes low, and thus an inadequate magnet is obtained.

In this embodiment, the coercivity is improved by causing crystal grains of a main phase to have an elliptical shape or an oval shape extended in such a direction so as to cross a c-axis direction, in addition to including a transition metal-rich phase. Therefore, Dy may not be contained, and even when Dy is contained, a sufficiently high coercivity improving effect is obtained when the Dy content in all of the rare earth elements is 65 at % or less.

Examples of the rare earth elements other than Dy in the R-T-B magnet include Sc, Y, La, Ce, Pr, Nd, Pm, Sm, Eu, Gd, Tb, Ho, Er, Tm, Yb, and Lu. Among these, Nd, Pr, and Tb are particularly preferably used. In addition, the rare earth element R preferably contains Nd as a main component.

B contained in the R-T-B magnet is boron and a part thereof can be substituted by C or N. The amount of B is 4.5 to 5.5 at %. The amount of B is preferably 4.8 to 5.3 at %. Sufficient coercivity is obtained when the amount of B contained in the R-T-B magnet is adjusted to 4.5 at % or greater.

In addition, when the amount of B is adjusted to 5.5 at % or less, the transition metal-rich phase is sufficiently generated in manufacturing of the R-T-B magnet.

The R-T-B magnet of this embodiment contains M which represents the metal element being Al and/or Ga in an amount of 0.1 to 2.0 at %. The amount of the metal element M is preferably 0.7 at % or greater. The amount of the metal element M is preferably 1.4 at % or less.

When the amount of the metal element M is adjusted to 0.1 at % or greater, the transition metal-rich phase is sufficiently generated in manufacturing of the R-T-B magnet. In the case in which the metal element M is Al, a reduction in remanence occurring due to entering of Al atoms into the main phase in manufacturing of the R-T-B magnet can be suppressed when the amount of Al is adjusted to 2.0 at % or less. In addition, the metal element M is preferably Ga, because Ga does not enter into the main phase, but enters into the transition metal-rich phase. When the metal element M is Ga, the coercivity improving effect is saturated and the coercivity is not further improved even when the amount of G is greater than 2.0 at %.

In the R-T-B magnet of this embodiment, the coercivity is reduced when Cu is contained. However, 0.05 to 0.2 at % of Cu is preferably contained. When Cu is less than 0.05 at %, sintering is not sufficiently performed, and thus a variation in the magnetic properties of the R-T-B magnet occurs. When Cu is not contained in the R-T-B magnet, sintering is not sufficiently performed, and thus sufficient magnetic properties cannot be obtained. The R-T-B magnet can be easily sintered when containing 0.05 at % or greater of Cu. In addition, a reduction in coercivity can be sufficiently suppressed when the amount of Cu is adjusted to 0.2 at % or less.

T contained in the R-T-B magnet is a transition metal which contains Fe as the essential components. Various Group 3 elements to Group 11 elements can be used as transition metals other than Fe contained in T of the R-T-B magnet. T of the R-T-B magnet preferably contains Co other than Fe, because the Curie temperature (Tc) can be improved.

The R-T-B magnet of this embodiment may contain 0.05 to 1.0 at % of Zr. The R-T-B magnet contains Zr in an amount of 0.05 to 1.0 at %, and preferably 0.1 to 0.5 at %, because the corrosion resistance of the magnet can be improved thereby. When the amount of Zr is less than 0.05 at %, the effects of Zr cannot be sufficiently obtained. When the amount of Zr is adjusted to 1.0 at % or less, a deterioration in squareness occurring due to the addition of an excessive amount of Zr can be avoided.

In the R-T-B magnet of this embodiment, the grain boundary phase includes an R-rich phase in which a total atomic concentration of the rare earth element R is 70 at % or greater and a transition metal-rich phase in which the total atomic concentration of the rare earth element R is 25 to 35 at %. The transition metal-rich phase preferably contains 50 to 70 at % of T, which represents a transition metal essentially containing Fe.

In this embodiment, the atomic concentration of Fe in the transition metal-rich phase is preferably 50 to 70 at %. The transition metal-rich phase mainly contains an $R_6T_{13}M$-type metal compound. Accordingly, in this case, the value of the atomic concentration of Fe is close to 65 at %. When the atomic concentration of Fe in the transition metal-rich phase is within the above range, the coercivity (Hcj) improving effect of the transition metal-rich phase is more effectively obtained. When the atomic concentration of Fe in the transition metal-rich phase is out of the above range, there is a concern that an $R_2T_{17}$ phase or Fe is precipitated and causes adverse effects on the magnetic properties.

In the R-T-B magnet of this embodiment, a magnetization direction of the main phase is a c-axis direction, and crystal grains of the main phase have an elliptical shape or an oval shape extended in such a direction so as to cross the c-axis direction.

In this embodiment, the main phase includes preferably 50% or more of crystal grains having an aspect ratio of 2 or greater, and more preferably 60% or more of crystal grains having an aspect ratio of 2 or greater. The aspect ratio is the ratio of a long axis to a short axis (long axis/short axis) of the crystal grain. The aspect ratio of this embodiment is a value calculated by performing ellipse approximation through a rectangular method using the length of the long axis of an ellipse (an ellipse equivalent to an object) having zero-, first-, and second-order moments equal to the object as a "long-axis length" and using a length of the short axis of the ellipse equivalent to the object as a "short-axis length". When 50% or more of crystal grains of the main phase have an aspect ratio of 2 or greater, higher coercivity is obtained.

Next, in this embodiment, the reason why the coercivity is improved when the magnetization direction of the main phase is the c-axis direction, and crystal grains of the main phase have an elliptical shape or an oval shape extended in such a direction so as to cross the c-axis direction will be described with reference to the drawings.

Figure 1B:
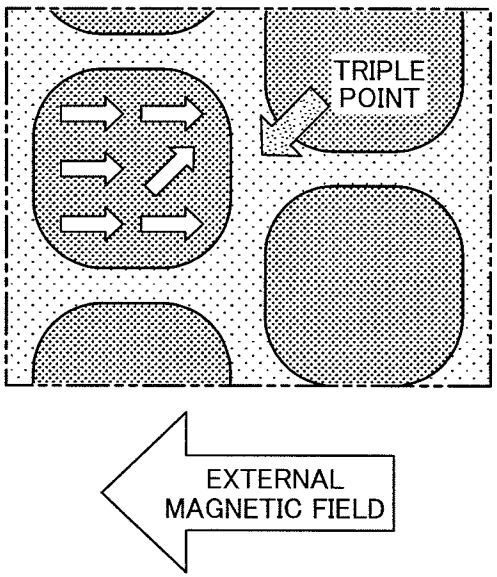
Figure 1C:
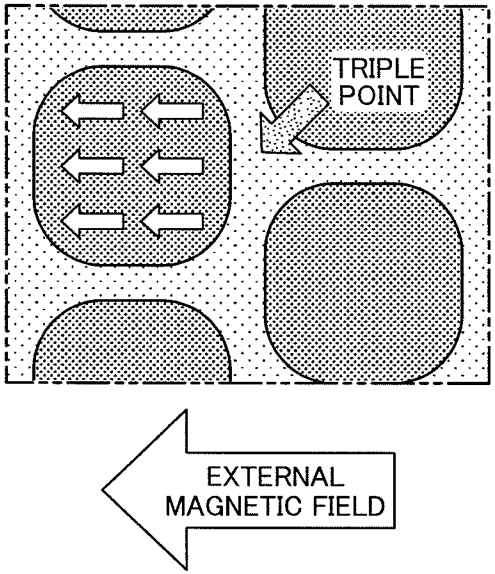
Figure 2A:
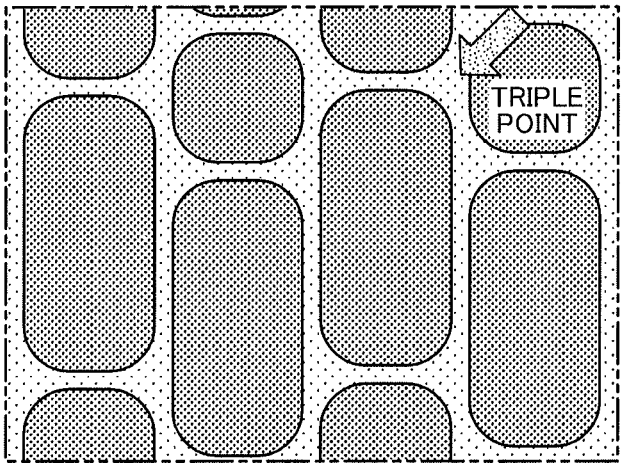
FIGS. 2A and 2B are schematic diagrams which show the relationship between the number of triple points and the shape of crystal grains of a main phase of the R-T-B magnet.
Figure 2B:
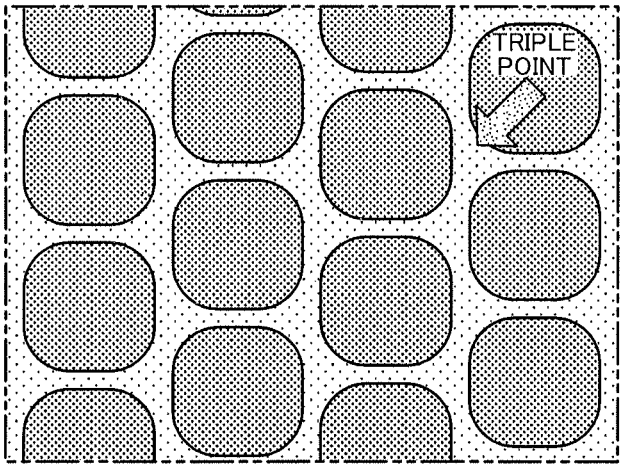

FIGS. 1A to 1C are schematic diagrams which show a coercivity mechanism (magnetic domain reversal) of the R-T-B magnet. FIGS. 2A and 2B are schematic diagrams which show the relationship between the number of triple points and the shape of crystal grains of the main phase of the R-T-B magnet. FIG. 2A is a schematic diagram showing an example of the R-T-B magnet of this embodiment, and FIG. 2B is a schematic diagram showing a conventional R-T-B magnet. In FIGS. 1A to 1C and 2A and 2B, a dark gray region represents main phase grains, and a light gray region represents a grain boundary phase. In this specification, "a triple point" means a point which is surrounded by three main phases.

In the R-T-B magnet shown in FIG. 1A, a magnetic domain (which is expressed by the arrow pointing to the right in FIG. 1A) of crystal grains of the main phase is in the opposite direction to that of an external magnetic field (which is expressed by the arrow pointing to the left in FIG. 1A). The R-T-B magnet has a nucleation-type coercivity mechanism. In this coercivity mechanism, when a reverse magnetic domain is formed as shown in FIG. 1B, the magnetic domains of all of the magnetic grains are reversed in a very short time (as expressed by the arrow pointing to the left in FIG. 1C) as shown in FIG. 1C and become the same direction as that of the external magnetic field. In general, as shown in FIG. 1B, the reverse magnetic domain of the R-T-B magnet is generated from a triple point surrounded by three main phase particles.

When crystal grains of the main phase have an elliptical shape or an oval shape extended in such a direction so as to cross the c-axis direction so as in the R-T-B magnet of this embodiment shown in FIG. 2A, triple points are more difficult to form compared to a case in which crystal grains of the main phase have a nearly spherical shape as in the conventional R-T-B magnet shown in FIG. 2B. Thus the number of triple points is reduced. As a result, it is presumed that in the R-T-B magnet of this embodiment, it is difficult for the reverse magnetic domain to form and the coercivity thus increases.

In addition, as shown in FIG. 2A, the higher the ratio of crystal grains having a large aspect ratio, which are included in crystal grains of the main phase, the more difficult it is to form triple points. In the R-T-B magnet of this embodiment, when 50% or more of crystal grains of the main phase have an aspect ratio of 2 or greater, it is significantly difficult for the reverse magnetic domain to form in the R-T-B magnet, and thus the coercivity is further increased. The ratio of crystal grains having an aspect ratio of 2 or greater in the crystal grains of the main phase is more preferably 60% or more to obtain an R-T-B magnet having higher coercivity. In addition, the ratio of the main phases with an aspect ratio of 2 or greater is preferably 90% or less. An R-T-B magnet in which the ratio of the main phases with an aspect ratio of 2 or greater is 90% or less can be easily manufactured by sintering an alloy for an R-T-B magnet in which a distance between adjacent grain boundary phases to be described later is 1.5 μm to 2.8 μm.

In addition, when crystal grains of the main phase have a pointed part such as an angle (corner), the tip thereof may be a base point at which a reverse magnetic domain is formed. Accordingly, the crystal grains of the main phase preferably have a smooth rounded surface, rather than a pointed part such as an angle.

[Method of Manufacturing R-T-B Magnet]

In a method of manufacturing an R-T-B magnet of this embodiment, first, an alloy for an R-T-B magnet is provided.

The alloy for an R-T-B magnet which is used in this embodiment has a similar composition to that of the above-described R-T-B magnet. Accordingly, the alloy for an R-T-B magnet contains 4.5 to 5.5 at % of B and 0.1 to 2.0 at % of a metal element M which represents Al and/or Ga.

In the alloy for an R-T-B magnet which is used in this embodiment, the amount of B is smaller compared to conventional R-T-B magnet materials, and is thus within a restricted range. The alloy for an R-T-B magnet having such a composition is presumed to include an $R_2T_{17}$ phase which is not desirably contained in a magnet. An R-T-B magnet in which a transition metal-rich phase mainly contains an $R_6T_{13}M$-type metal compound is obtained using, as an alloy for an R-T-B magnet, a material in which the amount of B is smaller compared to the conventional cases and an $R_2T_{17}$ phase is thus included. The $R_2T_{17}$ phase is presumed to be used as a raw material of the transition metal-rich phase together with the metal element M when manufacturing an R-T-B magnet using the alloy for an R-T-B magnet.

The metal element M contained in the alloy for an R-T-B magnet promotes the formation of the transition metal-rich phase in sintering used to manufacture an R-T-B magnet to effectively improve coercivity (Hcj). When the alloy for an R-T-B magnet contains 0.1 at % or greater of the metal element M, the generation of the transition metal-rich phase is sufficiently promoted, and thus an R-T-B magnet having higher coercivity is obtained. When the alloy for an R-T-B magnet contains more than 2.0 at % of the metal element M, magnetic properties such as remanence (Br) and a maximum energy product (BHmax) of an R-T-B magnet manufactured using the foregoing alloy for an R-T-B magnet are degraded.

The alloy for an R-T-B magnet includes a main phase mainly including $R_2Fe_{14}B$ and a grain boundary phase including a larger amount of R than the main phase, and distance between adjacent grain boundary phases are 1.5 μm to 2.8 μm. When the alloy for an R-T-B magnet is pulverized, it is broken at a grain boundary phase part having a low mechanical strength. Therefore, when the distance between adjacent grain boundary phases is 1.5 μm to 2.8 μm, the grains of the powder have an elliptical shape or an oval shape, and in an R-T-B magnet obtained by sintering the powder, crystal grains of a main phase have an elliptical shape or an oval shape extended in such a direction so as to cross the c-axis direction. The distance between adjacent grain boundary phases of the alloy for an R-T-B magnet is more preferably 1.8 μm to 2.6 μm. When the distance between adjacent grain boundary phases is greater than 2.8 μm, crystal grains of the main phase are difficult to have an elliptical shape or an oval shape extended in such a direction so as to cross the c-axis direction. It is not preferable that distance between adjacent grain boundary phases are less than 1.5 μm, because the grain diameter of the pulverized powder is reduced and a powder surface is easily oxidized.

The alloy for an R-T-B magnet of this embodiment can be manufactured using, for example, the following method.

First, a cast alloy is manufactured through a strip cast (SC) method including supplying a molten alloy to a cooling roll and solidifying the molten alloy (casting step).

In this embodiment, a molten alloy having a similar composition to the above-described R-T-B magnet is prepared at a temperature of, for example, 1200° C. to 1500° C. Next, the obtained molten alloy is supplied to the cooling roll using a tundish and solidified to separate the resulting cast alloy from the cooling roll at 400° C. to 600° C., and a cast alloy having an average thickness of 0.15 mm to 0.27 mm is obtained.

In this embodiment, since the temperature of the cast alloy which is removed from the cooling roll is 400° C. to 600° C., an alloy for an R-T-B magnet in which a distance between adjacent grain boundary phases is 1.5 μm to 2.8 μm is obtained. The temperature of the cast alloy which is removed from the cooling roll is more preferably 420° C. to 580° C. When the temperature of the cast alloy which is removed from the cooling roll is higher than 600° C., the distance between adjacent grain boundary phases may not be 2.8 μm or less. It is not preferable that the temperature of the cast alloy which is removed from the cooling roll is lower than 400° C., in order to prevent the crystallinity of the main phase from becoming poor.

In this embodiment, a cast alloy having an average thickness of 0.15 mm to 0.27 mm is manufactured in the casting step. The average thickness of the cast alloy is more preferably 0.18 mm to 0.25 mm. Since the average thickness of the cast alloy is 0.15 mm to 0.27 mm, an alloy for an R-T-B magnet in which a distance between adjacent grain boundary phases is 1.5 μm to 2.8 μm is obtained by adjusting the temperature of the cast alloy which is removed from the cooling roll to 400° C. to 600° C. When the average thickness of the cast alloy is greater than 0.27 mm, the cast alloy is not sufficiently cooled, and thus distance between adjacent grain boundary phases may not be 2.8 μm or less. In addition, it is not preferable that the average thickness of the cast alloy is less than 0.15 mm, in order to prevent the crystallinity of the main phase from becoming poor.

In this embodiment, the average cooling rate until a molten metal supplied to the cooling roll is removed as a cast alloy from the cooling roll is preferably 800° C./s to 1000° C./s, and more preferably 850° C./s to 980° C./s. When the average cooling rate is adjusted to 800° C./s to 1000° C./s, the temperature of the cast alloy which is removed from the cooling roll can be easily adjusted to 400° C. to 600° C., and thus an alloy for an R-T-B magnet in which a distance between adjacent grain boundary phases is 1.5 μm to 2.8 μm is easily obtained. When the average cooling rate is lower than 800° C./s, the distance between adjacent grain boundary phases may not be 2.8 μm or less. It is not preferable that the average cooling rate is higher than 1000° C./s, in order to prevent the crystallinity of the main phase from becoming poor.

The obtained cast alloy is crushed into cast alloy flakes by crushing. The cast alloy flakes are cracked using a hydrogen decrepitation method or the like and pulverized using a pulverizer such as a jet mill to obtain an R-T-B alloy.

The hydrogen decrepitation method is performed in order of, for example, storing hydrogen at room temperature in cast alloy flakes, performing a heat treatment in the hydrogen at a temperature of approximately 300° C., and performing a heat treatment at a temperature of approximately 500° C. under reduced pressure to remove the hydrogen in the cast alloy flakes.

In the hydrogen decrepitation method, the cast alloy flakes storing the hydrogen are expanded in volume, and thus a large number of cracks are caused in the alloy and the decrepitation is easily performed.

The grain diameter (d50) of the powder made from the R-T-B alloy obtained as described above is preferably 3.5 μm to 4.5 μm. It is not preferable that the grain diameter of the powder made from the R-T-B alloy is within the above range, because oxidation can be prevented in the process.

In this embodiment, 0.02 mass % to 0.03 mass % of zinc stearate as a lubricant is added to the powder made from the R-T-B alloy, and the resulting material is subjected to press molding using a molding machine or the like in the transverse field and sintered at 800° C. to 1200° C. in vacuum. Then, a heat treatment is performed to manufacture an R-T-B magnet.

When a sintering temperature is 800° C. to 1200° C., crystal grains of the main phase do not remarkably grow from the diameter of the pulverized grains even when sintering is performed. Thus, a compact sintered body is obtained. Sintering may not be performed when the sintering temperature is lower than 800° C. It is not preferable that the sintering temperature is higher than 1200° C., because crystal grains of the main phase excessively grow by sintering and the coercivity and the squareness of the R-T-B magnet are thus reduced. The sintering temperature is preferably 1000° C. to 1100° C.

A sintering time is preferably 0.5 hours to 20 hours. When the sintering time is within the above range, the grains which will be an R-T-B magnet do not excessively grow from the diameter of the pulverized grains even when sintering is performed. Thus, a compact sintered body is obtained. Sintering may not be performed when the sintering time is shorter than 0.5 hours. It is not preferable that the sintering time is longer than 20 hours, because crystal grains of the main phase grow excessively and the coercivity and the squareness of the R-T-B magnet are thus significantly reduced.

The heat treatment after the sintering is preferably performed for 0.5 hours to 3 hours at a temperature of 400° C. to 800° C. under an argon atmosphere.

The R-T-B magnet of this embodiment has the above-described composition and is formed of a sintered body including a main phase and a grain boundary phase, the grain boundary phase includes an R-rich phase and a transition metal-rich phase, a magnetization direction of the main phase is a c-axis direction, and crystal grains of the main phase have an elliptical shape or an oval shape extended in such a direction so as to cross the c-axis direction. Accordingly, the R-T-B magnet has high coercivity with a suppressed Dy content (preferably 0 at % of Dy), and has excellent magnetic properties so as to be properly used in motors.

In this embodiment, a Dy metal or a Dy compound may be adhered to a surface of the R-T-B magnet after the sintering and then a heat treatment may be performed.

Specifically, for example, an R-T-B magnet after the sintering is dipped in a coating liquid obtained by mixing a solvent such as ethanol and dysprosium fluoride ($DyF_3$) at a predetermined ratio, to apply the coating liquid to the R-T-B magnet. Thereafter, a heat treatment is performed on the R-T-B magnet to which the coating liquid is applied.

In this case, by performing the heat treatment, the transition metal-rich phase is generated and Dy is diffused in the sintered magnet. Thus, an R-T-B magnet having higher coercivity is obtained.

As a method of adhering a Dy metal or a Dy compound to a surface of the R-T-B magnet using a method other than the above-described method before the heat treatment is performed after sintering, for example, a method including vaporizing a Dy metal or a Dy compound to adhere a film made therefrom to a magnet surface, a method including decomposing an organic metal to adhere a film to a surface, or the like may be used.

In addition, in place of the Dy metal or the Dy compound, a Tb metal or a Tb compound may be adhered to a surface of the R-T-B magnet after the sintering and then a heat treatment may be performed.

In this case, the Tb metal or the Tb compound can be adhered in the same manner as in the method of adhering a Dy metal or a Dy compound to the surface of the R-T-B magnet before the heat treatment is performed after sintering. In addition, by performing the heat treatment on the R-T-B magnet to which the Tb metal or the Tb compound is adhered, the transition metal-rich phase is generated and Tb is diffused in the sintered magnet. Thus, an R-T-B magnet having higher coercivity is obtained.

EXAMPLES

Test Examples 1 to 16, Comparative Examples 1 to 3

An Nd metal (having a purity of 99 wt % or greater), a Pr metal (having a purity of 99 wt % or greater), an Al metal (having a purity of 99 wt % or greater), ferroboron (Fe 80 wt %, B 20 wt %), a lump of iron (having a purity of 99 wt % or greater), a Ga metal (having a purity of 99 wt % or greater), a Co metal (having a purity of 99 wt % or greater), a Cu metal (having a purity of 99 wt %), and a Zr metal (having a purity of 99 wt % or greater) were weighed to provide a composition shown in Table 1 and were put into an alumina crucible. C, O, and N shown in Table 1 are inevitable impurities contained in the raw materials. The concentration of O slightly increases during the manufacturing of the alloy.

Thereafter, the atmosphere in a high frequency vacuum induction furnace in the alumina crucible was substituted by Ar and melting was performed by heating to 1450° C. to obtain a molten alloy. Next, a cast alloy was provided through a strip cast (SC) method including supplying the obtained molten alloy to a water cooling roll made from copper using a tundish and solidifying the molten alloy, and was removed from the cooling roll at a cast alloy removal temperature (cast alloy separation temperature) shown in Table 2. Whereby, cast alloys of Test Examples 1 to 16 and Comparative Examples 1 to 3, each having an average thickness shown in Table 2, were obtained.

The average cooling rate until a molten alloy supplied to the cooling roll is peeled off as a cast alloy from the cooling roll is shown in Table 2.

Next, the cast alloys of Test Examples 1 to 16 and Comparative Examples 1 to 3 were crushed into cast alloy flakes by crushing. Regarding the obtained cast alloy flakes of Test Examples 1 to 16 and Comparative Examples 1 to 3, a distance between adjacent grain boundary phases (R-rich interval) was measured using the following method.

The cast alloy flakes of Test Examples 1 to 16 and Comparative Examples 1 to 3 were embedded in resins, respectively, to observe a cross-section subjected to mirror polishing in a reflection electron image at 500-fold magnification, a main phase and a grain boundary phase were distinguished by the contrast thereof, and the distance between adjacent grain boundary phases was examined. Regarding the distance between adjacent grain boundary phases, a straight line parallel to a casting surface was drawn at intervals of 10 μm on the reflection electron images of the respective cast alloy flakes, and distance between grain boundary phases across the straight line were measured. Approximately 300 intervals between grain boundary phases were measured for each alloy and the average value thereof was calculated. The results are shown in Table 2 and FIG. 3.

Figure 3:
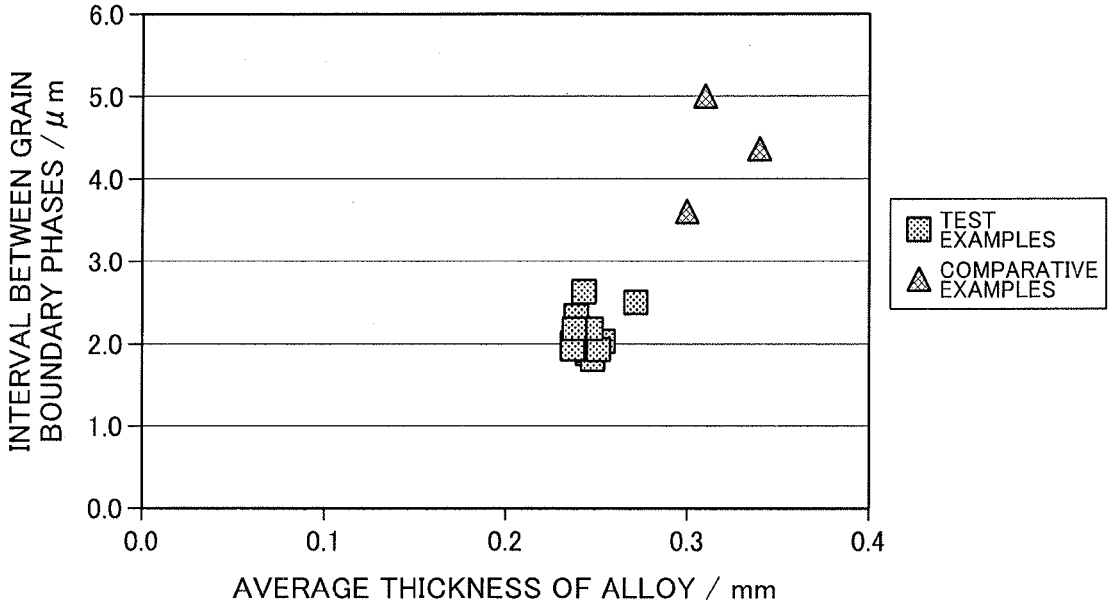
FIG. 3 is a graph showing the relationship between the average thickness of a cast alloy and a distance between adjacent grain boundary phases of a cast alloy flake.

FIG. 3 is a graph showing the relationship between an average thickness of the cast alloy and a distance between adjacent grain boundary phases of the cast alloy flake, of Test Examples 1 to 16 and Comparative Examples 1 to 3.

As shown in Table 2 and FIG. 3, it is found that when the average thickness of the cast alloy is 0.15 mm to 0.27 mm, the distance between grain boundary phases is 1.5 μm to 2.8 μm.

Figure 4A:
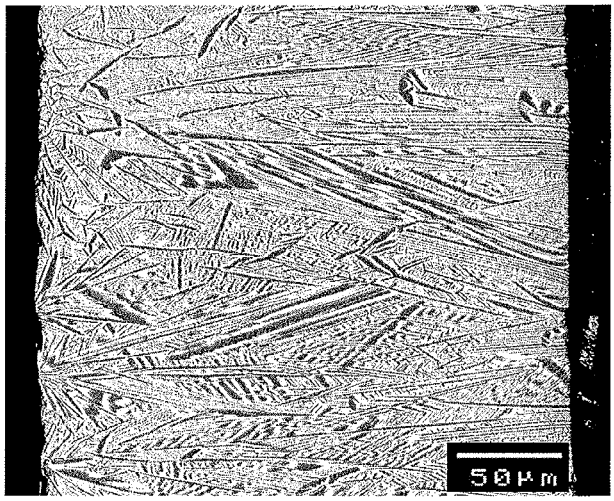
FIG. 4A is a microscope photograph of a cast alloy flake of Test Example 4.
Figure 4B:
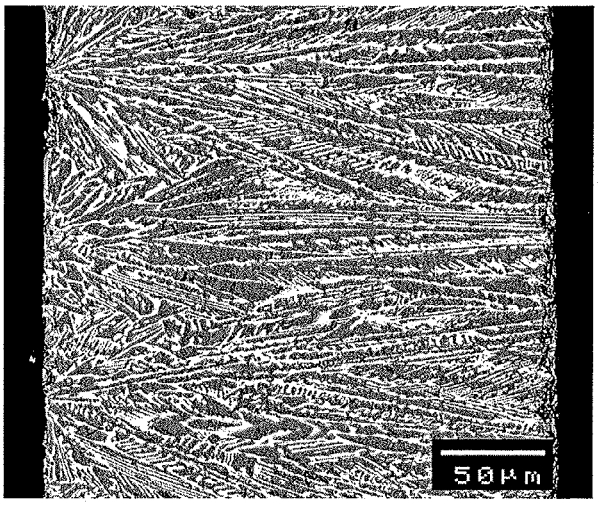
FIG. 4B is a microscope photograph of a cast alloy flake of Comparative Example 1.
Figure 4C:
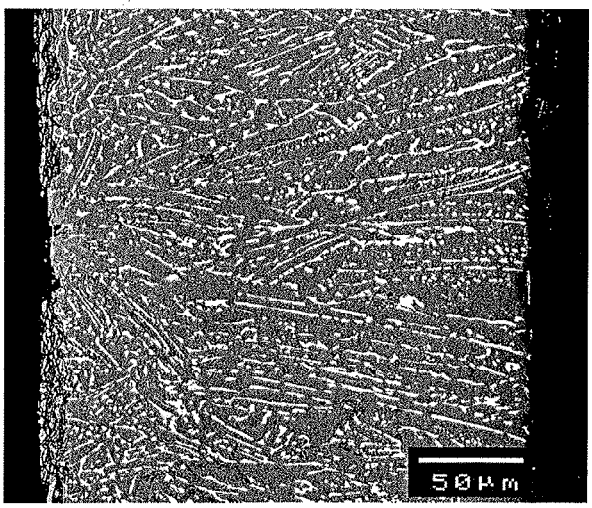
FIG. 4C is a microscope photograph of a cast alloy flake of Comparative Example 2.

In addition, FIGS. 4A to 4C show microscope photographs obtained by observing the cast alloy flakes of Test Example 4 and Comparative Examples 1 and 2 in the reflection electron images at 500-fold magnification. FIG. 4A is a microscope photograph of the cast alloy flake of Test Example 4, FIG. 4B is a microscope photograph of the cast alloy flake of Comparative Example 1, and FIG. 4C is a microscope photograph of the cast alloy flake of Comparative Example 2.

In the microscopic photograph shown in FIG. 4A to 4C, a gray part indicates a main phase and a white part indicates a grain boundary phase.

The cast alloy flake of Test Example 4 had a needle-like structure as shown in FIG. 4A, and the distance between adjacent grain boundary phases was sufficiently small, (i.e., 2.0 μm) as shown in Table 2.

However, in Comparative Example 1 shown in FIG. 4B and Comparative Example 2 shown in FIG. 4C, since the cast alloy had a large thickness, cooling was not sufficiently performed and the structure was thus bloated compared to the cast alloy flake of Test Example 4. Therefore, as shown in Table 2, the distance between adjacent grain boundary phases was 3.6 μm in Comparative Example 1 and was 5.0 μm in Comparative Example 2, and the distance was very large compared to Test Example 4.

The cast alloy flakes of Test Examples 1 to 16 and Comparative Examples 1 to 3 were cracked using the following hydrogen decrepitation method. First, the cast alloy flakes were roughly pulverized into a diameter of approximately 5 mm and hydrogen was stored therein at room temperature under a 1 atm hydrogen atmosphere. Next, the roughly pulverized cast alloy flakes storing the hydrogen were heat-treated for heating to 300° C. in the hydrogen. Then, the temperature was increased from 300° C. to 500° C. under reduced pressure and a heat treatment was performed for maintaining at 500° C. for 1 hour to discharge and remove the hydrogen in the cast alloy flakes. Next, Ar was supplied into the furnace to perform cooling to room temperature.

Next, 0.025 wt % of zinc stearate as a lubricant was added to the cast alloy flakes subjected to the hydrogen decrepitation, and the cast alloy flakes subjected to the hydrogen decrepitation were finely pulverized into a powder diameter (d50) shown in Table 2 using high-pressure nitrogen of 0.6 MPa with a jet mill (100AFG, Hosokawa Micron Group) to obtain R-T-B alloy powders of Test Examples 1 to 16 and Comparative Examples 1 to 3.

Next, the R-T-B alloy powders of Test Examples 1 to 16 and Comparative Examples 1 to 3 obtained as described above were subjected to press molding at a molding pressure of 0.8 t/cm$^2$ using a molding machine in the transverse field in a magnetic field of 1.0 T to obtain compacts. Thereafter, the obtained compacts were sintered by maintaining at a temperature of 1000° C. to 1080° C. for 3 hours in a vacuum. After the sintering, a heat treatment was performed for maintaining at a temperature of 400° C. to 800° C. for 0.5 hours to 3 hours under an argon atmosphere, and thus R-T-B magnets of Test Examples 1 to 16 and Comparative Examples 1 to 3 were produced.

The obtained R-T-B magnets of Test Examples 1 to 16 and Comparative Examples 1 to 3 were embedded in epoxy resins, respectively, and a surface parallel to an axis of easy magnetization (C axis) was shaved off to be subjected to mirror polishing. This surface subjected to the mirror polishing was observed in a reflection electron image at 1500-fold magnification, and a main phase, an R-rich phase, and a transition metal-rich phase were distinguished by the contrast thereof.

As a result, it was found that in Test Examples 1 to 16 and Comparative Examples 1, a white R-rich phase in which the total atomic concentration of the rare earth elements is 70 at % or greater and a gray transition metal-rich phase in which the total atomic concentration of the rare earth elements is 25 to 35 at % were present at the grain boundaries of a black $R_2T_{14}B$ phase.

A composition of the grain boundary phase in the R-T-B magnet was analyzed by using Electron Probe Micro Analyzer.

As a result, the total atomic concentration of the R-rich phase was 74.8 at % and the total atomic concentration of the transition metal-rich phase was 27.5 at %.

Figure 5A:
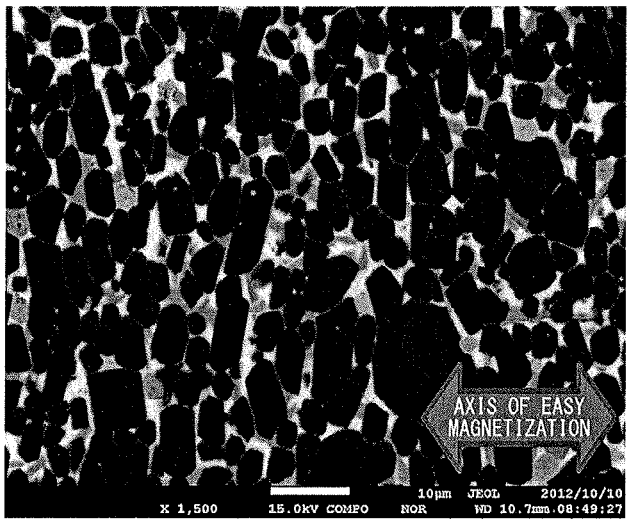
FIGS. 5A to 5C are microscope photographs obtained by observing R-T-B magnets in reflection electron images.
Figure 5B:
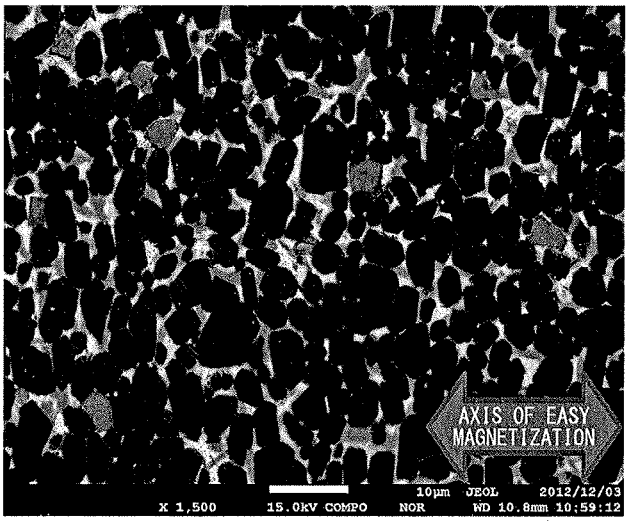
Figure 5C:
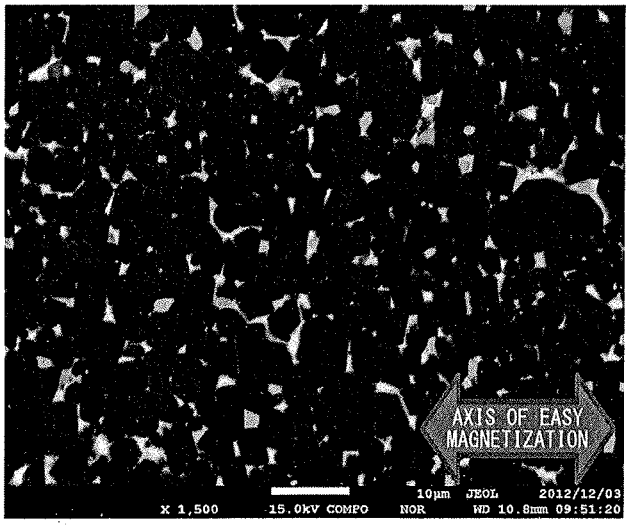

FIGS. 5A to 5C are microscope photographs obtained by observing the R-T-B magnets in backscattered electron images. FIG. 5A is a microscope photograph of Test Example 4, FIG. 5B is a microscope photograph of Comparative Example 1, and FIG. 5C is a microscope photograph of Comparative Example 2. The direction of the axis of easy magnetization (C axis) of the R-T-B magnets shown in FIGS. 5A to 5C is a horizontal direction in FIGS. 5A to 5C.

As shown in FIG. 5A, in the R-T-B magnet of Test Example 4, crystal grains of the main phase had an elliptical shape or an oval shape extended in such a direction so as to cross the c-axis direction.

However, in the R-T-B magnet of Comparative Example 1 shown in FIG. 5B and the R-T-B magnet of Comparative Example 2 shown in FIG. 5C, crystal grains of the main phase had a shape close to a spherical shape, compared to the R-T-B magnet of Test Example 4.

The R-T-B magnets of Test Example 1 to 16 and Comparative Examples 1 to 3 were formed into rectangular parallelepipeds having a side of 6 mm and magnetic properties of each rectangular parallelepiped were measured with a BH curve tracer (TPM2-10, Toei Industry Co., Ltd.). The results are shown in Table 2 and FIG. 6.

In Table 2, "Hcj" is coercivity, "Br" is remanence, and "BHmax" is a maximum energy product. Each of the values of these magnetic properties is an average of measurement values of five R-T-B magnets.

In addition, aspect ratios of crystal grains of the main phases of the R-T-B magnets of Test Examples 1 to 16 and Comparative Examples 1 to 3 were calculated using the following method and the ratio of the main phases with an aspect ratio of 2 or greater was obtained. The results are shown in Table 2.

The aspect ratio was a ratio of a long axis to a short axis (long axis/short axis) and was calculated using the length of the long axis of an ellipse (an ellipse equivalent to an object) having zero-, first-, and second-order moments equal to the object as a "long-axis length" and using a length of the short axis of the ellipse equivalent to the object as a "short-axis length".

TABLE 1

| | ALLOY COMPOSITION (atomic %) | | | | | | | | | | | | |
|---|---|---|---|---|---|---|---|---|---|---|---|---|---|
| | TRE | Nd | Pr | Al | Fe | Ga | Cu | Co | Zr | B | C | O | N |
| TEST EXAMPLE 1 | 16.6 | 12.4 | 4.2 | 0.49 | bal. | 0.55 | 0.11 | 0.57 | 0.14 | 5.5 | 0.08 | 0.18 | 0.04 |
| TEST EXAMPLE 2 | 15.0 | 11.1 | 3.9 | 0.54 | bal. | 0.61 | 0.12 | 0.56 | 0.00 | 5.3 | 0.08 | 0.18 | 0.04 |
| TEST EXAMPLE 3 | 14.8 | 11.0 | 3.8 | 0.47 | bal. | 0.54 | 0.51 | 0.55 | 0.00 | 5.3 | 0.08 | 0.18 | 0.04 |
| TEST EXAMPLE 4 | 16.6 | 12.6 | 4.0 | 0.59 | bal. | 0.71 | 0.14 | 0.57 | 0.00 | 5.2 | 0.07 | 0.18 | 0.03 |
| TEST EXAMPLE 5 | 15.3 | 11.4 | 3.9 | 0.52 | bal. | 0.58 | 0.12 | 0.56 | 0.00 | 5.3 | 0.09 | 0.17 | 0.04 |
| TEST EXAMPLE 6 | 16.6 | 12.4 | 4.2 | 0.59 | bal. | 0.71 | 0.14 | 0.00 | 0.00 | 5.2 | 0.08 | 0.19 | 0.03 |
| TEST EXAMPLE 7 | 16.6 | 12.6 | 4.0 | 0.60 | bal. | 0.71 | 0.14 | 0.57 | 0.00 | 5.1 | 0.07 | 0.20 | 0.04 |
| TEST EXAMPLE 8 | 16.6 | 12.6 | 4.0 | 0.60 | bal. | 0.71 | 0.14 | 0.57 | 0.00 | 4.8 | 0.09 | 0.20 | 0.04 |
| TEST EXAMPLE 9 | 16.6 | 12.4 | 4.2 | 0.59 | bal. | 0.71 | 0.14 | 0.28 | 0.00 | 5.2 | 0.09 | 0.18 | 0.03 |
| TEST EXAMPLE 10 | 16.7 | 12.4 | 4.3 | 0.60 | bal. | 0.96 | 0.14 | 0.57 | 0.00 | 4.9 | 0.07 | 0.19 | 0.04 |
| TEST EXAMPLE 11 | 16.5 | 12.3 | 4.2 | 0.61 | bal. | 0.95 | 0.14 | 0.57 | 0.00 | 5.2 | 0.07 | 0.17 | 0.05 |
| TEST EXAMPLE 12 | 16.6 | 12.4 | 4.2 | 0.64 | bal. | 0.71 | 0.14 | 0.00 | 0.00 | 5.2 | 0.09 | 0.20 | 0.03 |
| TEST EXAMPLE 13 | 14.5 | 10.8 | 3.7 | 0.58 | bal. | 0.70 | 0.14 | 0.00 | 0.00 | 5.0 | 0.10 | 0.19 | 0.04 |
| TEST EXAMPLE 14 | 14.5 | 10.9 | 3.7 | 0.42 | bal. | 0.54 | 0.10 | 0.00 | 0.00 | 5.0 | 0.10 | 0.18 | 0.05 |
| TEST EXAMPLE 15 | 14.6 | 10.8 | 3.7 | 0.59 | bal. | 0.70 | 0.13 | 0.55 | 0.00 | 5.3 | 0.08 | 0.17 | 0.03 |
| TEST EXAMPLE 16 | 13.4 | 10.0 | 3.4 | 0.57 | bal. | 0.70 | 0.10 | 0.55 | 0.00 | 5.2 | 0.10 | 0.17 | 0.04 |
| COMPARATIVE EXAMPLE 1 | 16.6 | 12.4 | 4.2 | 0.59 | bal. | 0.71 | 0.14 | 0.00 | 0.00 | 5.2 | 0.07 | 0.18 | 0.05 |
| COMPARATIVE EXAMPLE 2 | 14.5 | 12.1 | 2.3 | 0.52 | bal. | 0.00 | 0.10 | 0.00 | 0.00 | 6.0 | 0.08 | 0.30 | 0.04 |
| COMPARATIVE EXAMPLE 3 | 16.6 | 12.4 | 4.2 | 0.59 | bal. | 0.71 | 0.14 | 0.00 | 0.00 | 5.2 | 0.07 | 0.18 | 0.05 |

TABLE 2

| | AVERAGE THICKNESS (mm) | R-RICH INTER-VAL (μm) | POWDER DIAMETER d50 (μm) | CAST ALLOY SEPARATION TEMPERATURE (° C.) | AVERAGE COOLING RATE (° C./s) | Br (kG) | Hcj (kOe) | BHmax (MGOe) | SQUARE-NESS RATIO (%) | RATIO OF MAIN PHASES WITH ASPECT RATIO OF 2 OR GREATER |
|---|---|---|---|---|---|---|---|---|---|---|
| TEST EXAMPLE 1 | 0.24 | 2.2 | 3.8 | 426 | 978 | 12.3 | 21.1 | 36.9 | 95.4% | 86.2% |
| TEST EXAMPLE 2 | 0.24 | 2.2 | 4.1 | 504 | 903 | 12.9 | 21.1 | 40.0 | 95.0% | 82.4% |
| TEST EXAMPLE 3 | 0.25 | 2.0 | 3.9 | 515 | 893 | 13.3 | 20.0 | 42.9 | 95.4% | 83.8% |
| TEST EXAMPLE 4 | 0.24 | 2.0 | 3.9 | 427 | 977 | 12.6 | 21.8 | 38.0 | 94.8% | 85.1% |
| TEST EXAMPLE 5 | 0.24 | 2.1 | 3.8 | 487 | 920 | 12.9 | 21.2 | 39.9 | 95.1% | 81.9% |
| TEST EXAMPLE 6 | 0.25 | 1.9 | 3.7 | 425 | 979 | 12.1 | 22.5 | 35.0 | 94.3% | 84.5% |
| TEST EXAMPLE 7 | 0.25 | 1.9 | 3.7 | 425 | 979 | 12.2 | 22.3 | 36.2 | 95.2% | 79.1% |
| TEST EXAMPLE 8 | 0.25 | 1.8 | 3.7 | 423 | 981 | 11.8 | 20.7 | 32.9 | 91.2% | 83.3% |
| TEST EXAMPLE 9 | 0.24 | 2.0 | 3.7 | 425 | 979 | 12.6 | 21.6 | 38.1 | 94.0% | 83.7% |
| TEST EXAMPLE 10 | 0.24 | 1.9 | 3.8 | 420 | 984 | 11.4 | 21.9 | 31.5 | 92.0% | 73.0% |
| TEST EXAMPLE 11 | 0.25 | 1.9 | 3.8 | 427 | 976 | 11.7 | 22.9 | 32.1 | 94.2% | 70.0% |
| TEST EXAMPLE 12 | 0.27 | 2.5 | 4.2 | 427 | 977 | 11.1 | 21.6 | 29.6 | 92.5% | 54.1% |
| TEST EXAMPLE 13 | 0.24 | 2.3 | 4.2 | 527 | 881 | 11.8 | 21.6 | 32.9 | 93.7% | 72.8% |
| TEST EXAMPLE 14 | 0.25 | 2.2 | 4.0 | 525 | 883 | 11.7 | 21.3 | 30.7 | 94.4% | 64.0% |
| TEST EXAMPLE 15 | 0.24 | 2.2 | 4.1 | 525 | 884 | 12.3 | 22.9 | 36.2 | 92.7% | 77.5% |
| TEST EXAMPLE 16 | 0.24 | 2.6 | 4.1 | 580 | 831 | 12.6 | 20.7 | 37.8 | 92.4% | 52.8% |
| COMPARATIVE EXAMPLE 1 | 0.30 | 3.6 | 4.3 | 630 | 783 | 11.9 | 17.9 | 34.0 | 94.7% | 48.1% |
| COMPARATIVE EXAMPLE 2 | 0.31 | 5.0 | 4.5 | 810 | 612 | 13.6 | 15.2 | 44.2 | 94.4% | 26.2% |
| COMPARATIVE EXAMPLE 3 | 0.34 | 4.4 | 4.3 | 644 | 770 | 13.6 | 17.1 | 44.2 | 94.9% | 36.0% |

Figure 6:
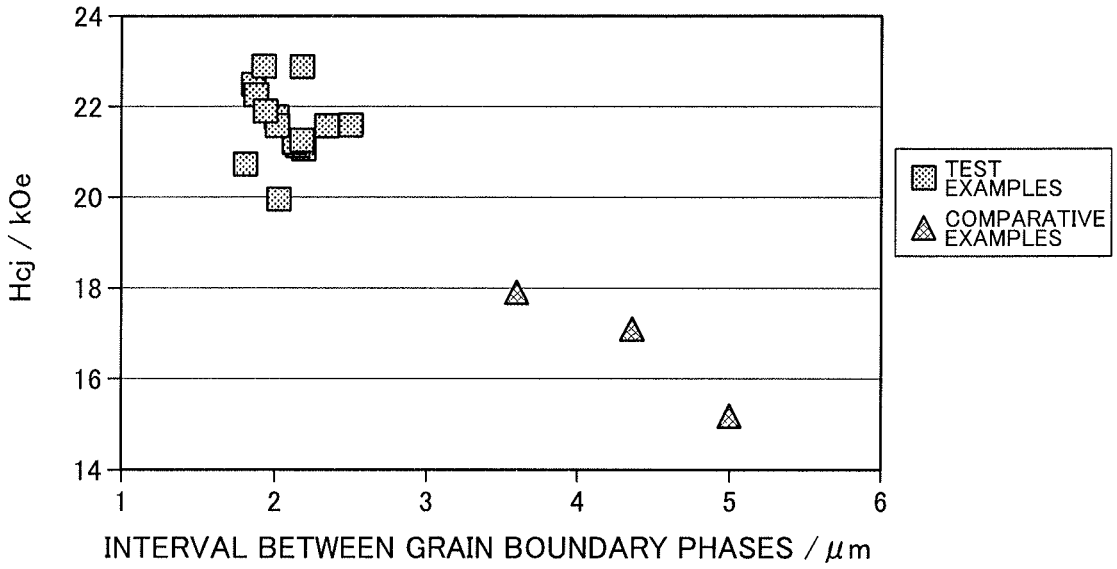
FIG. 6 is a graph showing the relationship between a distance between adjacent grain boundary phases of a cast alloy flake and coercivity of an R-T-B magnet.

FIG. 6 is a graph showing the relationship between a distance between adjacent grain boundary phases of the cast alloy flake and coercivity of the R-T-B magnet, of Test Examples 1 to 16 and Comparative Examples 1 to 3.

As shown in Table 2 and FIG. 6, it was found that when the distance between grain boundary phases of the cast alloy flake was 1.5 μm to 2.8 μm, an R-T-B magnet having high coercivity of 20 kOe or greater was obtained.

As shown in Table 2, the R-T-B magnets of Test Examples 1 to 16, which are the examples of the invention, had high coercivity compared to the R-T-B magnets of Comparative Examples 1 to 3 manufactured using an alloy in which the average thickness and the interval (distance) between adjacent grain boundary phases were out of the range of the invention.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An R-T-B rare earth sintered magnet comprising R which represents a rare earth element; T which represents a transition metal essentially containing Fe; a metal element M which represents Al and/or Ga; B; Cu; and inevitable impurities;

wherein the R-T-B rare earth sintered magnet contains 13.4 to 17 at % of R, 4.5 to 5.5 at % of B, and 0.1 to 2.0 at % of M and T as the balance;

wherein the R-T-B rare earth sintered magnet is formed of a sintered body which includes a main phase composed of $R_2Fe_{14}B$ and a grain boundary phase including a larger amount of R than the main phase;

wherein a magnetization direction of the main phase is a c-axis direction;

wherein crystal grains of the main phase have one of an elliptical shape and an oval shape extended in such a direction so as to cross the c-axis direction; and wherein the grain boundary phase includes an R-rich phase in which a total atomic concentration of the rare earth elements is 70 at % or greater, and a transition metal-rich phase in which a total atomic concentration of the rare earth elements is 25 to 35 at %.

2. The R-T-B rare earth sintered magnet according to claim 1, wherein 50% or more of the crystal grains of the main phase have an aspect ratio of 2 or greater.

3. The R-T-B rare earth sintered magnet according to claim 1, further comprising 0.05 to 1.0 at % of Zr.

* * * * *